US008922601B2

(12) United States Patent
Choi et al.

(10) Patent No.: US 8,922,601 B2
(45) Date of Patent: Dec. 30, 2014

(54) LIQUID CRYSTAL DISPLAY APPARATUS AND METHOD OF DRIVING THE SAME

(75) Inventors: Sang-Hyun Choi, Yongin (KR); Young-Nam Yun, Yongin (KR); Jung-Mi Jang, Yongin (KR); Sung-Kwon Kim, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 278 days.

(21) Appl. No.: 13/137,901

(22) Filed: Sep. 21, 2011

(65) Prior Publication Data

US 2012/0162294 A1 Jun. 28, 2012

(30) Foreign Application Priority Data

Dec. 28, 2010 (KR) ..... 10-2010-0137215

(51) Int. Cl.
*G09G 3/36* (2006.01)

(52) U.S. Cl.
CPC ..... *G09G 3/3648* (2013.01); *G09G 2300/0439* (2013.01); *G09G 2300/0809* (2013.01); *G09G 2300/0477* (2013.01)
USPC ..... 345/694

(58) Field of Classification Search
CPC ..... G09G 2300/0439; G09G 2300/0447; G09G 2300/0809; G09G 3/3648
USPC ..... 345/102, 694
See application file for complete search history.

(56) References Cited

U.S. PATENT DOCUMENTS

| | | | | |
|---|---|---|---|---|
| 5,986,725 | A | 11/1999 | Kim et al. | |
| 2002/0075435 | A1 | 6/2002 | Lee et al. | |
| 2003/0058211 | A1 | 3/2003 | Kim et al. | |
| 2007/0109238 | A1* | 5/2007 | Lee et al. | 345/87 |
| 2008/0042968 | A1* | 2/2008 | Oh | 345/102 |
| 2009/0015741 | A1* | 1/2009 | Kim | 349/33 |
| 2009/0295693 | A1* | 12/2009 | Yeom et al. | 345/88 |
| 2010/0014012 | A1* | 1/2010 | Irie et al. | 349/39 |

FOREIGN PATENT DOCUMENTS

| | | | |
|---|---|---|---|
| KR | 10-0272556 | B1 | 11/2000 |
| KR | 10 2010-0083300 | A | 9/2001 |
| KR | 10 2002-0050017 | A | 6/2002 |
| KR | 10 2003-0020153 | A | 3/2003 |
| KR | 10-2004-0009602 | A | 1/2004 |
| KR | 10 2004-0087744 | A | 10/2004 |
| KR | 10 2005-0080280 | A | 8/2005 |
| KR | 10 2009-0038609 | A | 4/2009 |

* cited by examiner

*Primary Examiner* — Quan-Zhen Wang
*Assistant Examiner* — Tony Davis
(74) *Attorney, Agent, or Firm* — Lee & Morse, P.C.

(57) ABSTRACT

Embodiments may be directed to a liquid crystal display apparatus, including a plurality of pixels, wherein each pixel of the plurality of pixels includes a first sub-pixel and a second sub-pixel, wherein the first sub-pixel and the second sub-pixel of a same pixel receive a same data signal and gate signal, wherein the first sub-pixel and the second sub-pixel include a first pixel electrode and a second pixel electrode, respectively, and wherein the first pixel electrode and the second pixel electrode have a first voltage difference at least during a light-emitting period, when a backlight unit emits light.

13 Claims, 10 Drawing Sheets

LIQUID CRYSTAL DISPLAY APPARATUS AND METHOD OF DRIVING THE SAME

CROSS-REFERENCE TO RELATED PATENT APPLICATION

This application claims the benefit of Korean Patent Application No. 10-2010-0137215, filed on Dec. 28, 2010, in the Korean Intellectual Property Office, the disclosure of which is incorporated herein in its entirety by reference.

BACKGROUND

1. Field

Embodiments relate to liquid crystal display apparatuses, and methods of driving the liquid crystal display apparatuses.

2. Description of the Related Art

A liquid crystal display apparatus displays an image corresponding to input data by converting the input data into a data signal in a data driver and adjusting brightness of each pixel by controlling scanning of each pixel by a gate driver. The liquid crystal display apparatus adjusts the brightness of each pixel by changing an orientation of liquid crystal molecules of a liquid crystal layer. The liquid crystal layer is embodied in various ways, i.e., a twisted nematic (TN) mode, a vertical alignment (VA) mode, an in-plane switching (IPS) mode, etc. Due to their low power consumption, liquid crystal display apparatuses have been widely used from large-size display apparatuses to small-size electronic apparatuses.

SUMMARY

Present embodiments may be directed to liquid crystal display apparatuses.

According to an embodiment, a liquid crystal display apparatus may include a plurality of pixels, wherein each pixel of the plurality of pixels includes a first sub-pixel and a second sub-pixel, wherein the first sub-pixel and the second sub-pixel of a same pixel receive a same data signal and gate signal, wherein the first sub-pixel and the second sub-pixel include a first pixel electrode and a second pixel electrode, respectively, and wherein the first pixel electrode and the second pixel electrode have a first voltage difference at least during a light-emitting period when a backlight unit emits light.

Each pixel of the plurality of pixels may include a first switching transistor including a gate electrode connected to a gate line, a first electrode connected to a data line, and a second electrode connected to the first pixel electrode; a first storage capacitor connected between the first pixel electrode and a storage common voltage line; and a coupling capacitor connected between the first pixel electrode and the second pixel electrode, wherein the first sub-pixel further includes a first liquid crystal layer interposed between the first pixel electrode and a common electrode connected to a liquid crystal common voltage line, and wherein the second sub-pixel further includes a second liquid crystal layer interposed between the second pixel electrode and the common electrode.

The first sub-pixel may include a second switching transistor including a gate electrode connected to a gate line, a first electrode connected to a data line, and a second electrode connected to the first pixel electrode; a second storage capacitor connected between the first pixel electrode and an alternating current (AC) common voltage line; and a first liquid crystal layer interposed between the first pixel electrode and a common electrode connected to a liquid crystal common voltage line, wherein the second sub-pixel includes: a third switching transistor including a gate electrode connected to the gate line, a first electrode connected to the data line, and a second electrode connected to the second pixel electrode; a third storage capacitor connected between the second pixel electrode and a storage common voltage line; and a second liquid crystal layer interposed between the second pixel electrode and the common electrode.

A storage common voltage transmitted through the storage common voltage line may be a direct current (DC) voltage, an AC common voltage applied to the second storage capacitor through the AC common voltage line may have a second voltage difference with respect to the storage common voltage, during a light-emitting period, and the second voltage difference may be determined so that the first pixel electrode and the second pixel electrode have the first voltage difference during the light-emitting period.

The AC common voltage may have a lower level than the storage common voltage, during a data storage period for storing a data signal transmitted through the data line in the second and third storage capacitors, through the second and third switching transistors, and the AC common voltage may have a higher level than the storage common voltage during the light-emitting period.

The liquid crystal display apparatus may further include a gate driver for outputting a gate signal to each pixel of the plurality of pixels through the gate line; a data driver for generating a data signal corresponding to an input image and outputting the data signal to each pixel of the plurality of pixels through the data line; and a common voltage driver for generating an AC common voltage and outputting the AC common voltage to each of the plurality of pixels through the AC common voltage line, wherein the common voltage driver generates the AC common voltage so as to have a second voltage difference with respect to the storage common voltage during a light-emitting period, and wherein the second voltage difference is determined so that the first pixel electrode and the second pixel electrode have the first voltage difference during the light-emitting period.

A liquid crystal layer of each of the first sub-pixel and the second sub-pixel is a twisted nematic (TN) mode or a vertical alignment (VA) mode liquid crystal layer.

A first voltage difference may be determined so that a differential function of a mean graph of a voltage-transmittance graph of a liquid crystal layer of the first sub-pixel and a voltage-transmittance graph of a liquid crystal layer of the second sub-pixel does not have a point corresponding to a value of zero.

According to another embodiment, a method of driving a liquid crystal display apparatus may include a plurality of pixels, wherein each pixel of the plurality of pixels includes at least two sub-pixels, and at least two storage capacitors corresponding to at least two sub-pixels, the method including applying a storage common voltage to a first storage capacitor from among at least two capacitors; and applying an alternating current (AC) common voltage to a second storage capacitor from among at least two storage capacitors, wherein the storage common voltage and the AC common voltage have a second voltage difference, at least during a light-emitting period, when a backlight unit of the liquid crystal display apparatus emits light, and wherein the second voltage difference is determined so that pixel electrodes of at least two sub-pixels have a first voltage difference during the light-emitting period.

The storage common voltage may be a direct current (DC) voltage and the AC common voltage is an AC voltage.

The applying of the AC voltage may include applying the AC common voltage with a lower level than the storage common voltage, during a data storage period, when a data signal is applied to at least two sub-pixels; and applying the AC common voltage with a higher level than the storage common voltage, during the light-emitting period.

The liquid crystal display apparatus may include a twisted nematic (TN) mode or a vertical alignment (VA) mode liquid crystal layer.

The first voltage difference may be determined so that a differential function of a mean graph of a voltage-transmittance graph of a liquid crystal layer of the first sub-pixel, from among at least two sub-pixels and a voltage-transmittance graph of a liquid crystal layer of the second sub-pixel, from among at least two sub-pixels, does not have a point corresponding to a value of zero.

BRIEF DESCRIPTION OF THE DRAWINGS

The above and other features and advantages will become more apparent by describing in detail exemplary embodiments with reference to the attached drawings, in which.

DETAILED DESCRIPTION

Korean Patent Application No. 10-2010-0137215, filed on Dec. 28, 2010, in the Korean Intellectual Property Office, and entitled: "Liquid Crystal Display Apparatus and Method of Driving the Same," is incorporated by reference herein in its entirety.

Embodiments will now be described more fully hereinafter with reference to the accompanying drawings. Embodiments may, however, be implemented in different forms and should not be construed as limited to the embodiments set forth herein.

Figure 1:
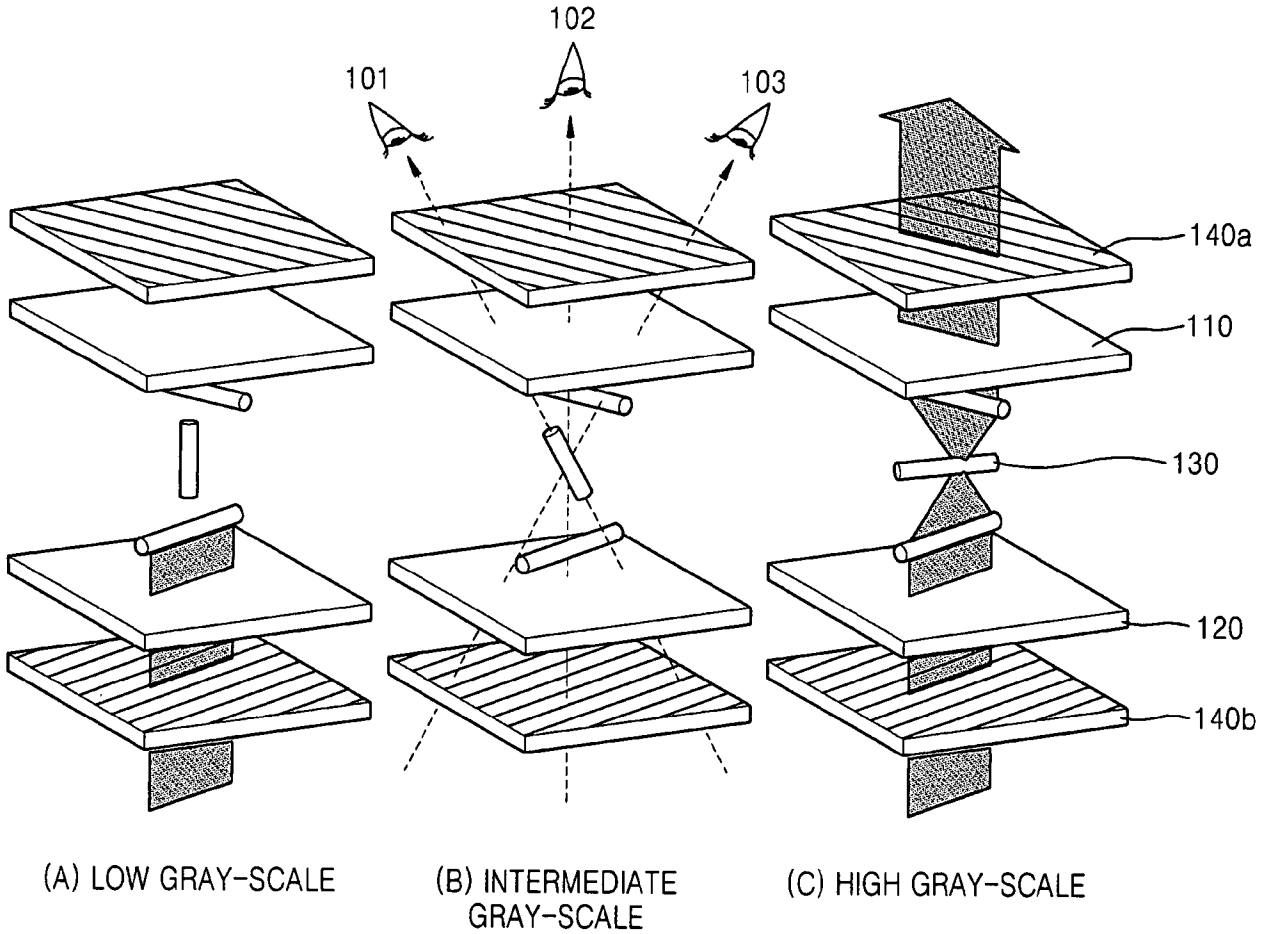
FIG. 1 is a schematic diagram for explaining an operation of a twisted nematic (TN) mode liquid crystal layer, according to an embodiment.

FIG. 1 is a schematic diagram for explaining an operation of a twisted nematic (TN) mode liquid crystal layer, according to an embodiment.

The TN mode liquid crystal layer is of a type in which an orientation of a liquid crystal molecule 130 adjacent to an upper electrode 110 is perpendicular to an orientation of a liquid crystal molecule 130 adjacent to a lower electrode 120. Thus, liquid crystals may have a twisted shape. In this case, the upper electrode 110 may be a common electrode and the lower electrode 120 may be a pixel electrode. In addition, the upper electrode 110 and the lower electrode 120 may be formed of indium tin oxide (ITO), indium zinc oxide (IZO), etc. Thus, the upper electrode 110 and the lower electrode 120 may be transparent. Polarization plates 140*a* and 140*b* are arranged adjacent to the upper electrode 110 and the lower electrode 120, respectively. Polarization directions of the polarization plates 140*a* and 140*b* are determined to correspond to the orientations of the liquid crystal molecules 130 adjacent to the upper electrode 110 and the lower electrode 120, respectively. The first polarization plate 140*a* adjacent to the upper electrode 110 has a polarization direction that corresponds to the orientation of the liquid crystal molecule 130 adjacent to the upper electrode 110. The second polarization plate 140*b* adjacent to the lower electrode 120 has a polarization direction that corresponds to the orientation of the liquid crystal molecule 130 adjacent to the lower electrode 120.

When a voltage is not applied between the upper electrode 110 and the lower electrode 120, light emitted from a backlight unit is twisted and is transmitted through a liquid crystal layer according to an orientation of a liquid crystal molecule 130. Thus, as shown in FIG. 1 (*c*), a high gray-scale is realized in a pixel. When a voltage corresponding to an intermediate gray-scale is applied between the upper electrode 110 and the lower electrode 120, transmittance of light emitted from the backlight unit is adjusted according to an orientation of the liquid crystal molecule 130. Thus, as shown in FIG. 1 (*b*), an intermediate gray-scale is realized. When a high voltage corresponding to a low gray-scale is applied between the upper electrode 110 and the lower electrode 120, transmittance of a liquid crystal layer is reduced. Thus, as shown in FIG. 1 (*a*), a low gray-scale is realized.

In the TN mode liquid crystal layer, because an orientation of the liquid crystal molecule 130 varies according to a viewing angle, the viewing angle may be narrow. Referring to FIG. 1B, when a user looks at a liquid crystal display apparatus from a position 101, because optical transmittance at the position 101 is low, the user senses a low gray-scale. When the user views a liquid crystal display apparatus from a position 103, since optical transmittance at the position 103 is high, the user senses a high gray-scale. However, in a position 102, when the user looks straight at the liquid crystal display apparatus, there is no low or high gray-scale. Thus, in the TN mode liquid crystal layer, brightness of the liquid crystal display apparatus may vary according to the viewing angle.

Figure 2:
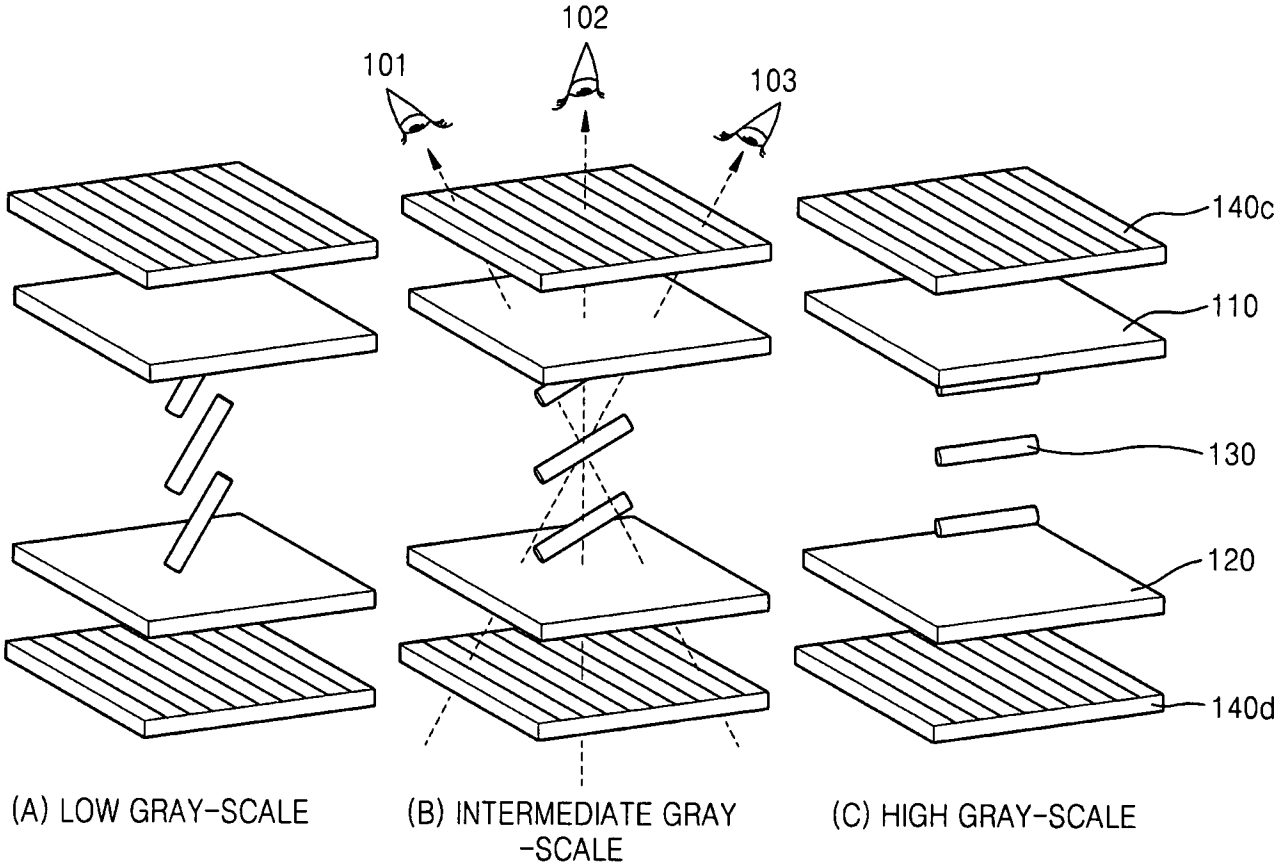
FIG. 2 is a diagram for explaining an operation of a vertical alignment (VA) mode liquid crystal layer, according to an embodiment.

FIG. 2 is a diagram for explaining an operation of a vertical alignment (VA) mode liquid crystal layer, according to an embodiment.

In the VA mode liquid crystal layer, as shown in FIG. 2 (*a*), when a voltage is not applied, the liquid crystal molecule 130 is almost vertically oriented. As shown in FIG. 2 (*c*), when a high voltage is applied between the upper electrode 110 and the lower electrode 120, the liquid crystal molecule 130 is horizontally arranged. When the liquid crystal molecule 130 is almost vertically oriented, as shown in FIG. 2 (*a*), a low gray-scale is realized. When the liquid crystal molecule 130 is horizontally oriented, as show in FIG. 2 (*c*), a high gray-scale is realized.

In the VA mode liquid crystal layer, brightness of the liquid crystal display apparatus may vary according to a viewing angle. As shown in FIG. 2B, in the VA mode liquid crystal display apparatus, brightness of the liquid crystal display apparatus may vary according to a direction in which a user looks at the liquid crystal display apparatus.

Figure 3A:
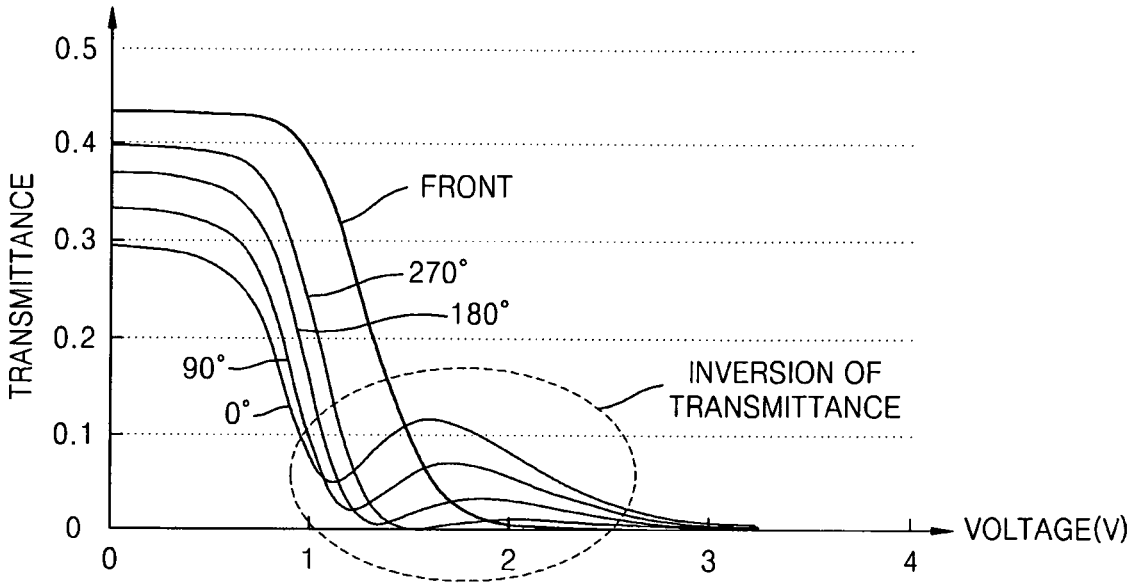
FIGS. 3A and 3B are diagrams for describing brightness inversion.
Figure 3B:
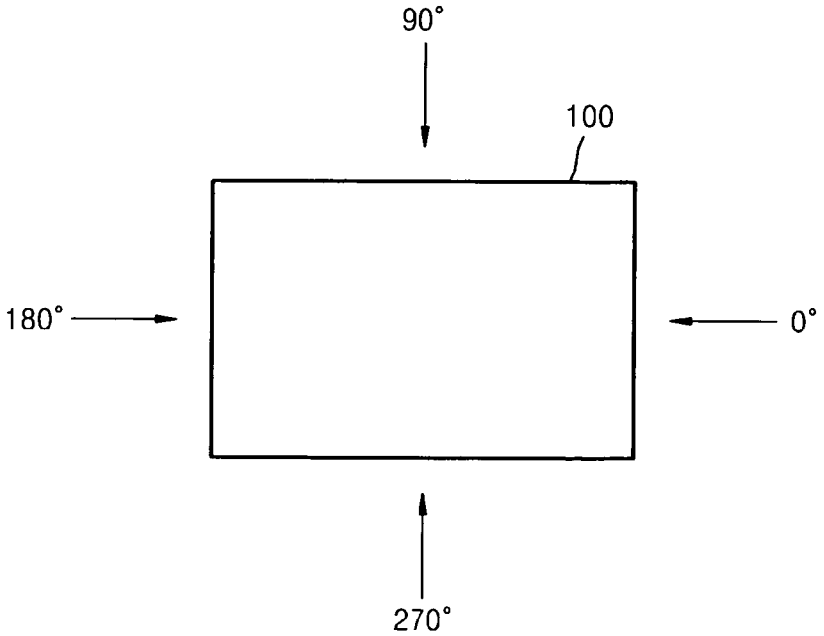

FIGS. 3A and 3B are diagrams for describing brightness inversion.

As described above, in a liquid crystal display apparatus 100 embodied in a TN mode or a VA mode, brightness inversion occurs in a certain gray-scale period. In particular, brightness inversion frequently occurs in a low gray-scale period. FIG. 3A is a graph for describing a change in transmittance of a liquid crystal layer according to a direction in which a user looks at a TN Mode liquid crystal display apparatus. In FIG. 3A, a voltage indicates the voltage applied between the upper electrode 110 (see FIG. 1) and the lower electrode 120 (see FIG. 1). As described above, in a TN mode liquid crystal display apparatus, a liquid crystal layer has high transmittance at a low voltage and low transmittance at a high voltage. Although voltage is increased during a low gray-scale period, gray-scale is increased. Thus, there is a deterioration of the display quality of a liquid crystal display apparatus. Although a film for improving a viewing angle brightness inversion is used, the problem is not overcome.

Brightness inversion occurs according to a direction in which a user looks at the liquid crystal display apparatus. The direction in which the user looks at the liquid crystal display apparatus is defined in FIG. 3B. Brightness inversion occurs because the direction differs in which the user looks at the liquid crystal display apparatus. Thus, brightness inversion occurs in the VA mode liquid crystal display apparatus.

Figure 4:
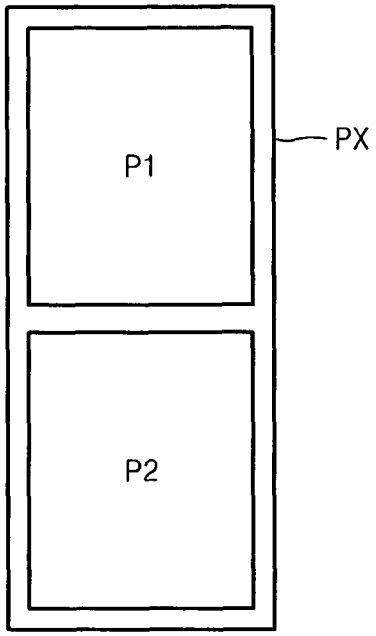
FIG. 4 is a diagram for describing a structure of a pixel of a liquid crystal display apparatus, according to an embodiment.

FIG. 4 is a diagram for describing a structure of a pixel PX of a liquid crystal display apparatus 100, according to an embodiment.

In order to overcome the above-described problems, the pixel PX includes at least two sub-pixels P1 and P2. The same data signal is applied to the sub-pixels P1 and P2. Pixel electrodes of the first sub-pixel P1 and the second sub-pixel P2 have a first voltage difference at least during a light-emitting period. The first sub-pixel P1 and the second sub-pixel P2 have the respective pixel electrodes, and are connected to the same data line and gate line. Thus, according to the present embodiment, lateral visibility may be improved by applying different pixel electrode voltages to the first and second sub-pixels P1 and P2 of the pixel PX without changing a data driver and a gate driver of the liquid crystal display apparatus 100.

Throughout this specification, a liquid crystal display apparatus is described in terms of a case where each pixel includes two sub-pixels. However, present embodiments are not limited thereto. A single pixel may include a plurality of sub-pixels such as 3, 4, 5 or 6 sub-pixels without departing from the spirit and scope of the embodiments.

Figure 5:
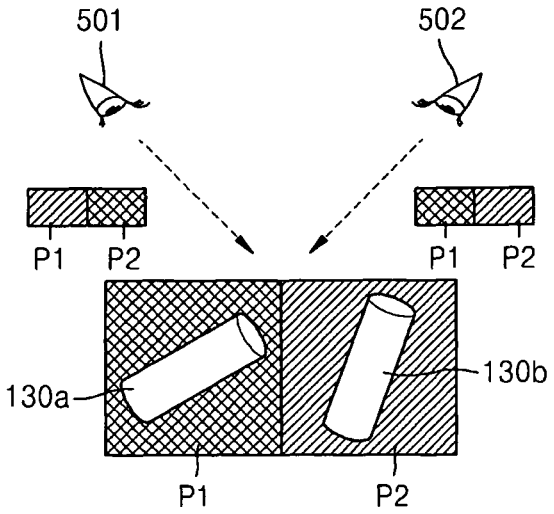
FIGS. 5 and 6 are diagrams for explaining effects obtained according to one or more embodiments.
Figure 6:
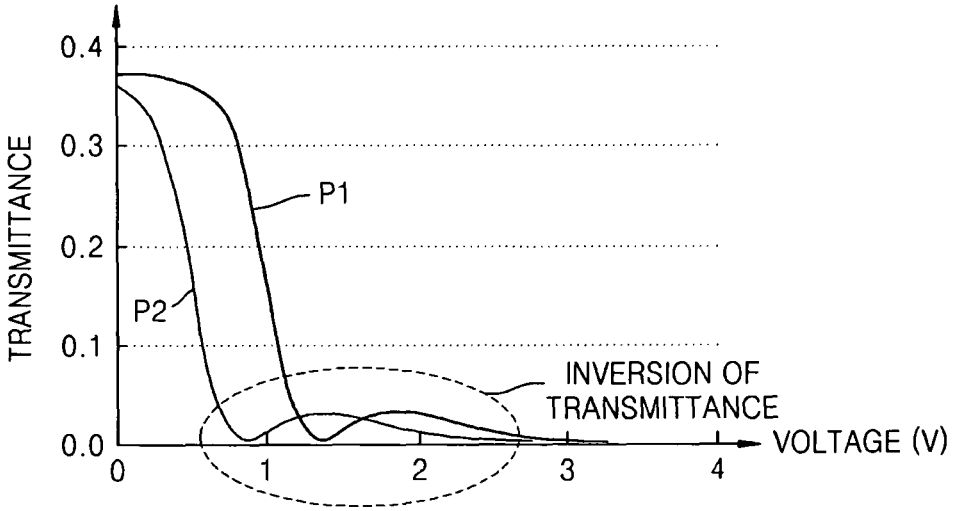

FIGS. 5 and 6 are diagrams for explaining effects obtained according to one or more embodiments.

As shown in FIG. 5, according to an embodiment, since the respective pixel electrodes of the first and second sub-pixels P1 and P2 have a first voltage difference, a liquid crystal molecule 130*a* of the first sub-pixel P1 and a liquid crystal molecule 130*b* of the second sub-pixel P2 have an orientation difference corresponding to the first voltage difference. Thus, the first and second sub-pixels P1 and P2 have a brightness difference corresponding to the first voltage difference. Brightness of the first sub-pixel P1 and brightness of the second sub-pixel P2 are spatially mixed, improving the problem of brightness inversion.

In FIG. 5, the brightness of the first sub-pixel P1 and the brightness of the second sub-pixel P2 are spatially mixed. According to an embodiment, a voltage higher than a voltage applied to the first sub-pixel P1, by as much as the first voltage difference, is applied to the second sub-pixel P2. Thus, the second sub-pixel P2 may have an orientation of the liquid crystal molecule 130*b*, which corresponds to a lower gray-scale than that of the first sub-pixel P1, by as much as the first voltage difference. The first sub-pixel P1 may have a higher gray-scale than that of the second sub-pixel P2, by as much as the first voltage difference. Thus, when a user looks at the liquid crystal display apparatus 100 from a position 501, the first sub-pixel P1 has a relatively high brightness, and the second sub-pixel P2 has a relatively low brightness. In addition, the brightness of the first sub-pixel P1 and the brightness of the second sub-pixel P2 are spatially mixed. Thus, the user obtains brightness corresponding to an intermediate gray-scale of the first sub-pixel P1 and the second sub-pixel P2. However, when the user looks at the liquid crystal display apparatus 100 from a position 502, brightness inversion occurs. In this case, the second sub-pixel P2 has a relatively high brightness, and the first sub-pixel P1 has a relatively low brightness. According to an embodiment, since the brightness of the first sub-pixel P1 and the brightness of the second sub-pixel P2 are spatially mixed, the user may obtain intermediate brightness of the brightness of the first sub-pixel P1 and the brightness of the second sub-pixel P2. Thus, brightness inversion is compensated. According to one or more embodiments, although the user looks at the liquid crystal display apparatus 100 from every viewing angle, the brightness of the first sub-pixel P1 and the brightness of the second sub-pixel P2 are spatially mixed. Thus, the user may view the same brightness, and overcome brightness inversion.

The improvement in brightness inversion according to one or more embodiments is described with reference to a voltage-transmittance graph of FIG. 6. FIG. 6 is a graph showing a change in transmittance when the user looks at the pixel PX from the position 502. As shown in FIG. 6, since the first sub-pixel P1 and the second sub-pixel P2 have a brightness difference corresponding to the first voltage difference, a voltage-transmittance graph of the second sub-pixel P2 is obtained by shifting a voltage-transmittance graph of the first sub-pixel P1 by as much as the first voltage difference. As shown in FIG. 6, if the second sub-pixel P2 has a higher voltage than that of the first sub-pixel P1, the first sub-pixel P1 has higher transmittance than that of the second sub-pixel P2 at the same voltage so as to emit light with a higher brightness than that of the second sub-pixel P2. However, in some brightness periods, brightness inversion occurs. According to one or more embodiments, the user may obtain brightness corresponding to a mean graph of the voltage-transmittance graph of the first sub-pixel P1 and the voltage-transmittance graph of the second sub-pixel P2, thereby compensating for brightness inversion.

The first voltage difference may be determined so as to remove brightness inversion through all brightness ranges. As an example, the first voltage difference may be determined so that a differential function of a mean graph of a voltage-transmittance graph of the first sub-pixel P1 and a voltage-transmittance graph of the second sub-pixel P2 may not have a point corresponding to a zero value. For example, in a case of the TN mode liquid crystal display apparatus 100 (see FIG. 3B), the first voltage difference may be determined so that the differential function of the mean graph of the voltage-transmittance graph of the first sub-pixel P1 and the voltage-transmittance graph of the second sub-pixel P2*b* may have points equal to or smaller than zero in all ranges.

Figure 7:
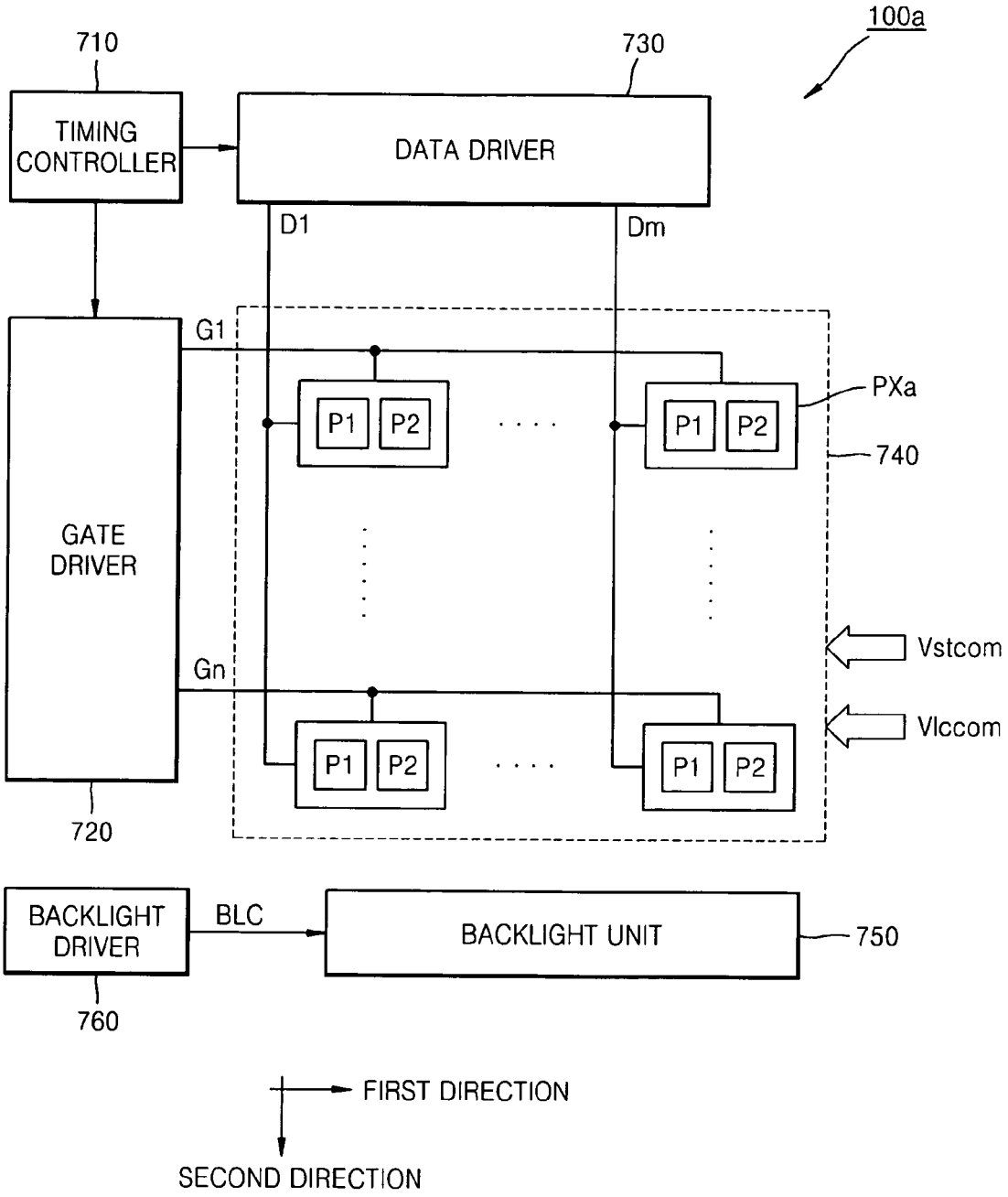
FIG. 7 is a block diagram of a liquid crystal display apparatus according to an embodiment.

FIG. 7 is a block diagram of a liquid crystal display apparatus 100*a* according to an embodiment.

The liquid crystal display apparatus 100*a* includes a timing controller 710, a gate driver 720, a data driver 730, a pixel unit 740, a backlight unit 750, and a backlight driver 760.

The timing controller 710 receives an input image signal, a data enable signal, a vertical synchronization signal, a horizontal synchronization signal, and a clock signal from an external graphic controller (not shown), and generates an image data signal, a data driving control signal, and a gate driving control signal.

The timing controller 710 receives an input control signal, the horizontal synchronization signal, the clock signal, the data enable signal, etc., and outputs the data driving control signal. In this case, the data driving control signal controls operations of the data driver 730, and may include a source shift clock, a source start pulse, a polarity control signal, a source output enable signal, etc. The timing controller 710 receives a vertical synchronization signal, a clock signal, etc., and outputs a gate driving control signal. The gate driving control signal controls operations of the gate driver 720 and may include a gate start pulse, a gate output enable signal, etc.

The gate driver 720 generates a gate signal having a sequential scan pulse according to an order of rows in response to the gate driving control signal applied from the timing controller 710, and applies the gate signal to gate lines G1 through Gn. In this case, the gate driver 720 determines a voltage level of each scan pulse according to a gate high voltage and a gate low voltage generated by a DC/DC converter (not shown). The voltage level of the scan pulse may vary according to the type of switching device included in a pixel PXa of the pixel unit 740. When the switching device in the pixel PXa is an n-type transistor, the scan pulse has a gate high voltage during activation. Alternatively, when the switching device is a p-type transistor, the scan pulse has a gate low voltage during activation.

The data driver 730 applies a data signal to data lines D1 through Dm in response to the image data signal and the data driving control signal applied from the timing controller 710. The data driver 730 samples and latches the image data signal applied from the timing controller 710 and converts the image data signal into an analog data signal. The analog data signal may express gray-scale in pixels PXa of the pixel unit 740 by using a gamma standard voltage applied from a gamma standard voltage circuit (not shown).

The pixel unit 740 includes the pixels PXa respectively disposed near to intersections between the data lines D1 through Dm and the gate lines G1 through Gn. Each of the pixels PXa is connected to at least one data line Di, at least one gate line Gj, a storage common voltage line, and a liquid crystal common voltage line. The storage common voltage line transmits a storage common voltage Vstcom (see FIG. 8), and the liquid crystal common voltage line transmits a liquid crystal common voltage Vlccom (see FIG. 8). The storage common voltage Vstcom (see FIG. 8) and the liquid crystal common voltage Vlccom (see FIG. 8) may be generated by the DC/DC converter. The gate lines G1 through Gn extend in parallel in a first direction and the data lines D1 through Dm extend in parallel in a second direction. Alternatively, the gate lines G1 through Gn may extend in parallel in the second direction, and the data lines D1 through Dm may extend in parallel in the first direction.

According to one or more embodiment, the pixel PXa includes the first sub-pixel P1 and the second sub-pixel P2. Hereinafter, a structure of the pixel PXa according to an embodiment will be described with reference to FIG. 8.

The backlight unit 750 is disposed on a rear surface of the pixel unit 740, emits light according to a backlight driving signal BLC applied from the backlight driver 760 and emits the light to the pixels PXa of the pixel unit 740. The backlight driver 760 generates the backlight driving signal BLC, outputs the backlight driving signal BLC to the backlight unit 750, and controls emission of the backlight unit 750, according to control of the timing controller 710.

Figure 8:
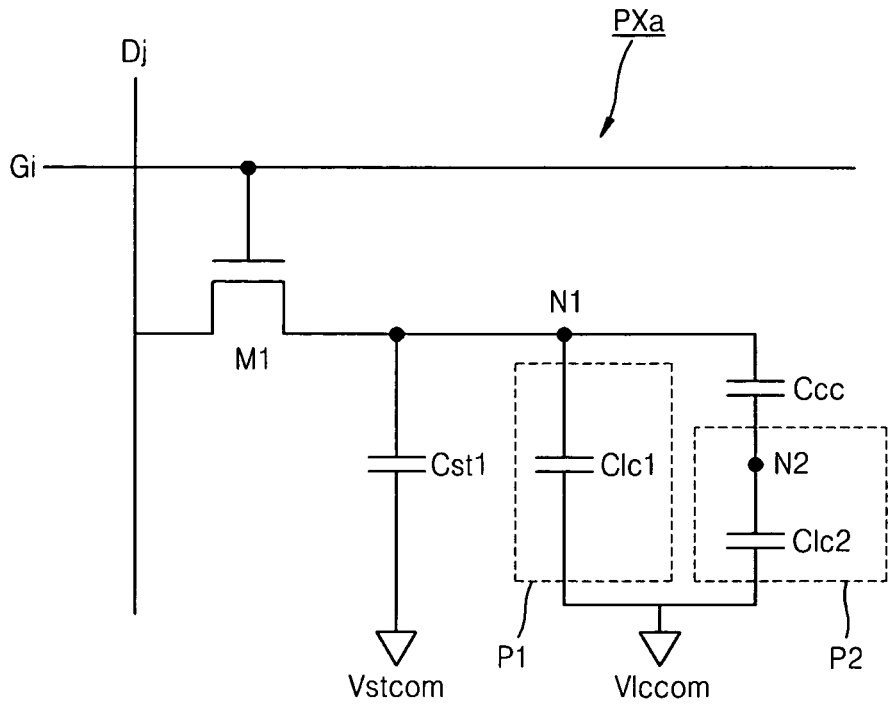
FIG. 8 is a circuit diagram of a pixel structure of a liquid crystal display apparatus, according to an embodiment.

FIG. 8 is a circuit diagram illustrating the structure of the pixel PXa, according to an embodiment. FIG. 8 shows the pixel PXa of an ith line (where i is a natural number greater than 0, and equal to or less than n) and a jth column (where j is a natural number greater than 0, and equal to or less than m).

The pixel PXa includes a first switching transistor M1, a first storage capacitor Cst1, a first liquid crystal layer Clc1, a second liquid crystal layer Clc2, and a coupling capacitor Ccc. The first liquid crystal layer Clc1 corresponds to the first sub-pixel P1 and the second liquid crystal layer Clc2 corresponds to the second sub-pixel P2.

The first switching transistor M1 includes a gate electrode connected to a gate line Gi, a first electrode connected to a data line Di, and a second electrode connected to a first node N1. The first storage capacitor Cst1 is connected between the first node N1 and the storage common voltage line for transmitting the storage common voltage Vstcom. The first liquid crystal layer Clc1 is interposed between a first pixel electrode connected to the first node N1 and a common electrode for transmitting the liquid crystal common voltage Vlccom. The second liquid crystal layer Clc2 is connected between a second pixel electrode connected to a second node N2 and the common electrode. The coupling capacitor Ccc is connected between the first node N1 and the second node N2.

According to an embodiment, a first voltage difference is stored in the coupling capacitor Ccc. The first node N1 and the second node N2 have a first voltage difference. Thus, an orientation of the first liquid crystal layer Clc1 and an orientation of the second liquid crystal layer Clc2 may always be different from each other by the first voltage difference. According to an embodiment, lateral visibility of the liquid crystal display apparatus 100*a* may be improved by only applying a common data signal, a gate voltage, the storage common voltage Vstcom and the liquid crystal common voltage Vlccom to the first sub-pixel P1 and the second sub-pixel P2 without applying a separate signal or voltage for embodying a plurality of sub-pixels.

Figure 9:
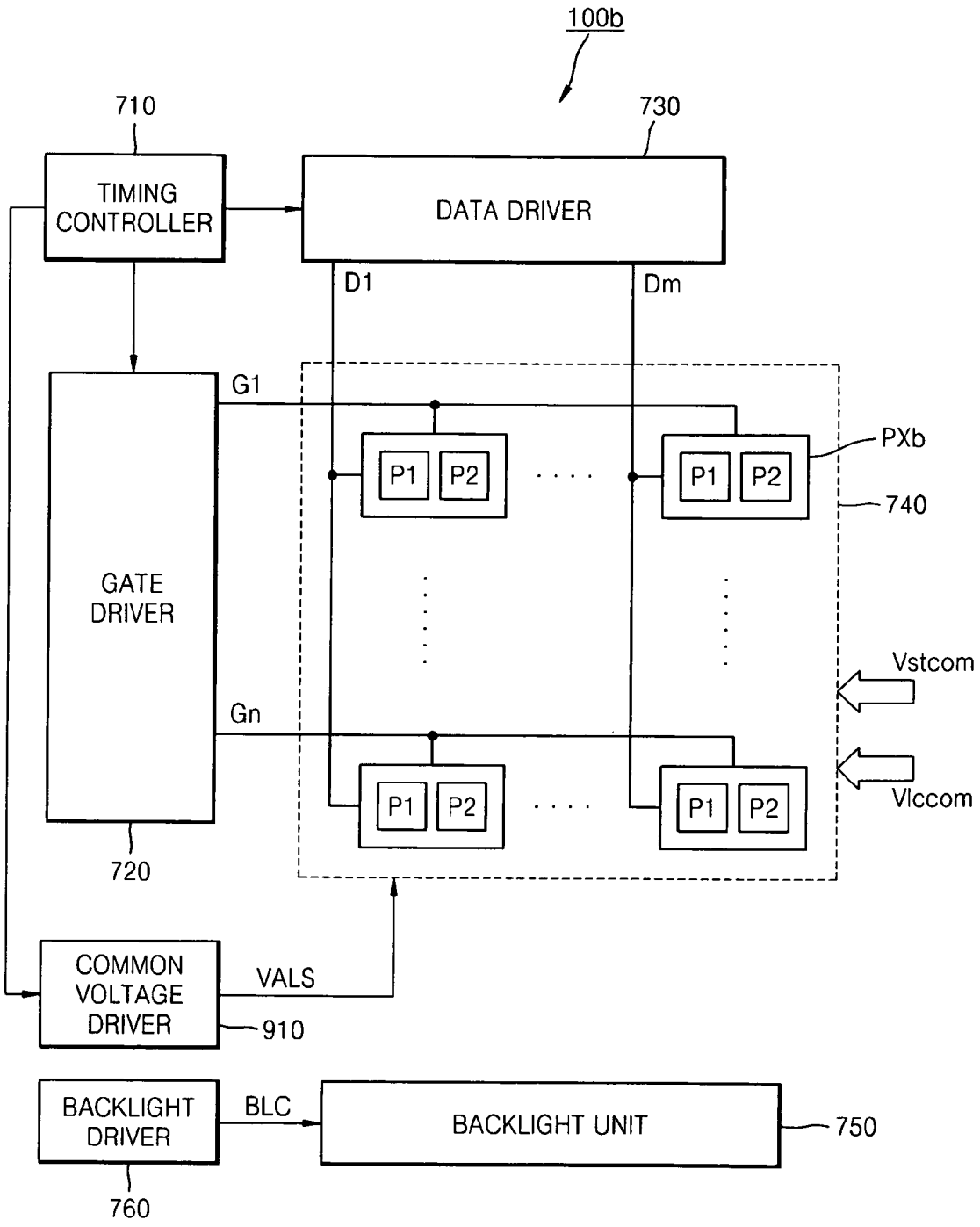
FIG. 9 is a block diagram of a liquid crystal display apparatus according to another embodiment.

FIG. 9 is a block diagram of a liquid crystal display apparatus 100*b* according to another embodiment.

The liquid crystal display apparatus 100*b* includes a timing controller 710, a data driver 720, a gate driver 730, a pixel unit 740, a backlight unit 750, a backlight driver 760, and a common voltage driver 910.

The common voltage driver 910 generates an alternating current (AC) common voltage VALS and outputs the AC common voltage VALS through an AC common voltage line. Operations of the common voltage driver 910 are described below with reference to FIG. 11.

Figure 10:
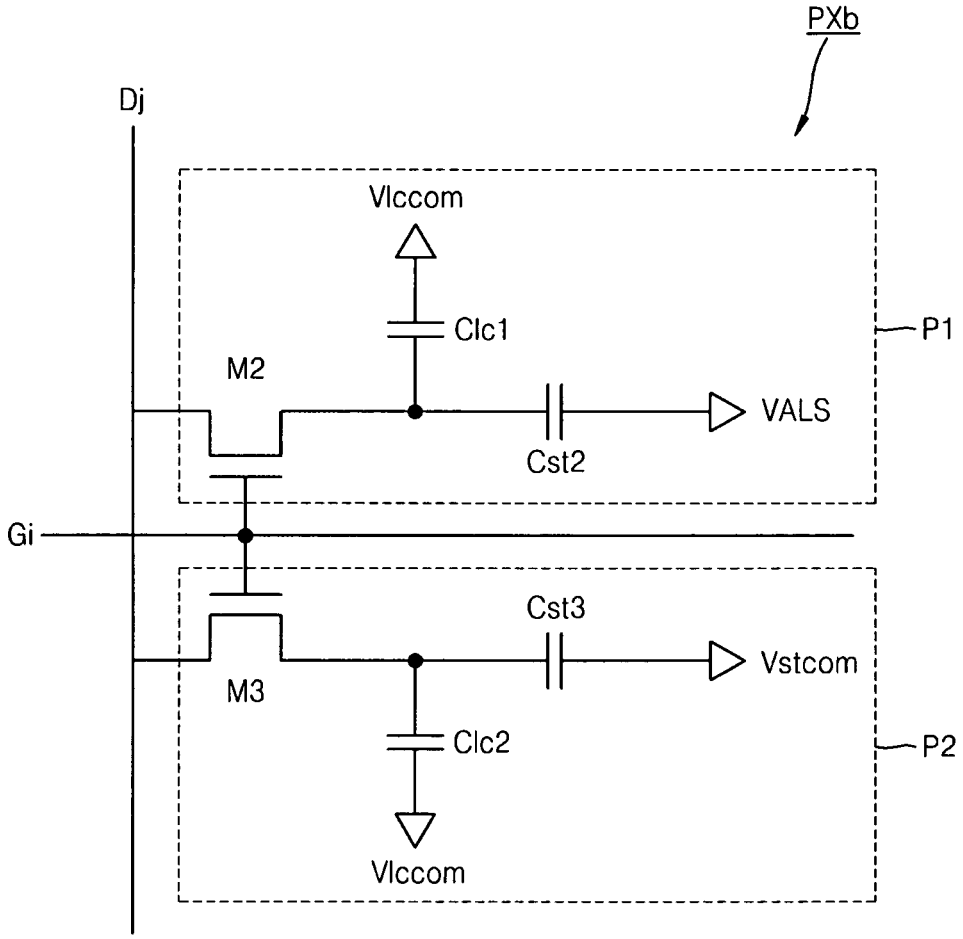
FIG. 10 is a circuit diagram of a pixel structure of a liquid crystal display apparatus, according to another embodiment.

FIG. 10 is a circuit diagram illustrating the structure of a pixel PXb of the liquid crystal display apparatus 100*b*, according to another embodiment.

The pixel PXb includes a second switching transistor M2, a third switching transistor M3, the first liquid crystal layer Clc1, the second liquid crystal layer Clc2, a second storage capacitor Cst2, and a third storage capacitor Cst3. The second switching transistor M2, the first liquid crystal layer Clc1, and the second storage capacitor Cst2 may correspond to the first sub-pixel P1. The third switching transistor M3, the second liquid crystal layer Clc2, and the third storage capacitor Cst3 may correspond to the second sub-pixel P2.

The second switching transistor M2 includes a gate electrode connected to the gate line Gi, a first electrode connected to the data line Di, and a second electrode connected to a third node N3. The first liquid crystal layer Clc1 is interposed between a first pixel electrode connected to the third node N3 and a common electrode connected to the liquid crystal common voltage line for transmitting the liquid crystal common voltage Vlccom. The second storage capacitor Cst2 is connected between the third node N3 and the AC common voltage line for transmitting the AC common voltage VALS.

The third switching transistor M3 includes a gate electrode connected to the gate line Gi, a first electrode connected to the data line Di, and a second electrode connected to a fourth node N4. The second liquid crystal layer Clc2 is interposed between a second pixel electrode connected to the fourth node N4, and the common electrode connected to the liquid crystal common voltage line for transmitting the liquid crystal common voltage Vlccom. The third storage capacitor Cst3 is connected between the fourth node N4 and the storage common voltage line for transmitting the storage common voltage Vstcom.

According to another embodiment, a common data signal is applied to the third node N3 and the fourth node N4 during a data storage period. However, the first liquid crystal layer Clc1 and the second liquid crystal layer Clc2 may have a first voltage difference by boosting a voltage of the third node N3 during the light-emitting period when the backlight unit 750 (see FIG. 9) emits light by driving of the AC common voltage VALS applied to the second storage capacitor Cst2. Thus, as described above, brightness of the first sub-pixel P1 and brightness of the second sub-pixel P2 are spatially mixed, thereby compensating for brightness inversion.

Figure 11:
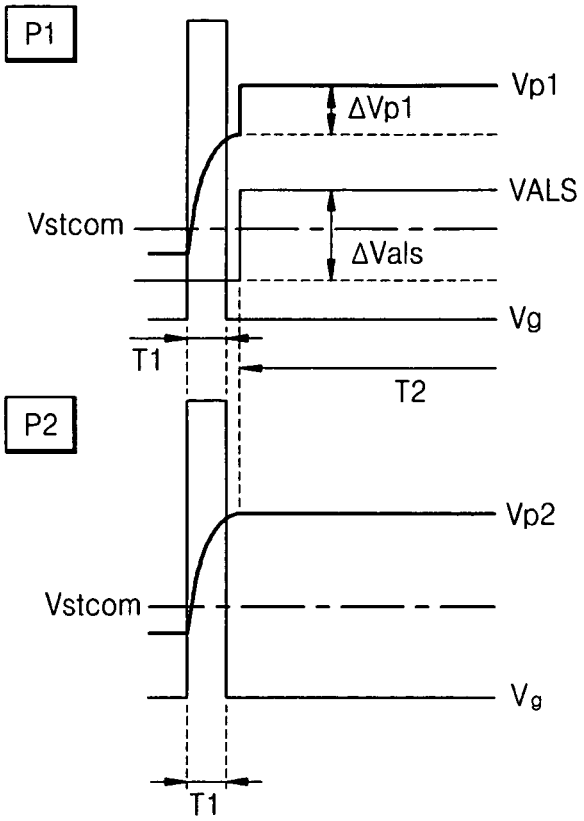
FIG. 11 is a timing diagram for describing driving of an alternating current (AC) common voltage, according to another embodiment.

FIG. 11 is a timing diagram for describing driving of the AC common voltage VALS, according to another embodiment.

According to one or more embodiments, the liquid crystal display apparatus 100*b* includes a data storage period T1 and a light-emitting period T2. As described above, in the data storage period T1, a scan pulse of a gate signal Vg is applied so that a data signal may be applied to a first pixel electrode of the first sub-pixel P1 and a second pixel electrode of the second sub-pixel P2, and a data signal may be stored in the second storage capacitor Cst2 and the third storage capacitor Cst3. In the light-emitting period T2, the backlight unit 750 emits light after the data signal is completely stored in the second storage capacitor Cst2 and the third storage capacitor Cst3.

According to another embodiment, the AC common voltage VALS is lower than the storage common voltage Vstcom during the data storage period T1, and is higher than the storage common voltage Vstcom during the light-emitting period T2. According to the present embodiment, in the light-emitting period T2, a voltage Vp1 of the third node N3 is boosted through the second storage capacitor Cst2 by as much as a first voltage difference ΔVp1 by shifting a voltage of the AC common voltage VALS by as much as ΔVals. The first difference voltage ΔVp1 is determined according to Equation 1 below. Thus, during the light-emitting period T2, a voltage, that is higher than the second liquid crystal layer Clc2 by as much as the first difference voltage ΔVp1, is applied to the first liquid crystal layer Clc1 during the light-emitting period T2.

$$\Delta Vp1 = \frac{Cst2}{Cst2 + Clc1} \times \Delta Vals \qquad \text{(Equation 1)}$$

In the second sub-pixel P2, since the storage common voltage Vstcom, which is a direct current (DC) voltage, is applied to the third storage capacitor Cst3, a voltage Vp2 of the fourth node N4 is maintained as a voltage of the data signal during the light-emitting period T2, and a voltage that is lower than the first liquid crystal layer Clc1, by as much as the first voltage difference ΔVp1, is applied to the second liquid crystal layer Clc2.

Throughout this specification, the AC common voltage VALS is applied to the first sub-pixel P1, and the storage common voltage Vstcom, which is a DC voltage, is applied to the second sub-pixel P2. However, one or more embodiments are not limited thereto. According to one or more embodiments, various changes in form and details may be made as long as the AC common voltage VALS and the storage common voltage Vstcom may be adjusted so that the first pixel electrode of the first sub-pixel P1 and the second pixel electrode of the second sub-pixel P2 may have the first voltage difference ΔVp1 during the light-emitting period T2. For example, both the AC common voltage VALS and the storage common voltage Vstcom may be AC voltages.

Throughout this specification, the AC common voltage VALS is shifted based on the storage common voltage Vstcom, which is a DC voltage. However, one or more embodiments are not limited thereto. For example, the AC common voltage VALS may always be higher or lower than the storage common voltage Vstcom.

Furthermore, the first voltage difference ΔVp1 may be adjusted by a user. The user may adjust the first voltage difference ΔVp1 according to a viewing angle mainly used by the user so as to customize a liquid crystal display apparatus. The common voltage driver 910 may generate and output the AC common voltage VALS according to the first voltage difference ΔVp1 that is adjusted by the user.

In the conventional art, since a liquid crystal layer of a liquid crystal display apparatus itself cannot emit light, the liquid crystal display apparatus has a limited viewing angle.

According to one or more embodiments, when a viewing angle is increased, a liquid crystal display apparatus prevents brightness inversion during some gray-scale periods.

In addition, the liquid crystal display apparatus may have an increased viewing angle.

Exemplary embodiments have been disclosed herein, and although specific terms are employed, they are used and are to be interpreted in a generic and descriptive sense only and not for purpose of limitation. Accordingly, it will be understood by those of ordinary skill in the art that various changes in form and details may be made.

What is claimed is:

1. A liquid crystal display apparatus, comprising:

a plurality of pixels, wherein each pixel of the plurality of pixels includes a first sub-pixel and a second sub-pixel, wherein the first sub-pixel and the second sub-pixel of a same pixel receive a same data signal and gate signal, wherein the first sub-pixel and the second sub-pixel include a first pixel electrode and a second pixel electrode, respectively, wherein the first pixel electrode and the second pixel electrode have a first voltage difference at least during a light-emitting period, when a backlight unit emits light, wherein the first sub-pixel includes:

a first switching transistor including a gate electrode connected to a gate line, a first electrode connected to a data line, and a first electrode connected to the first pixel electrode;

a first storage capacitor connected between the first pixel electrode and a common voltage line that receives an alternating current (AC) common voltage; and a first liquid crystal layer interposed between the first pixel electrode and a common electrode connected to a liquid crystal common voltage line, and wherein the second sub-pixel includes:

a second switching transistor including a gate electrode connected to the gate line, a first electrode connected to the data line, and a second electrode connected to the second pixel electrode, the gate electrode of the second switching transistor and the gate electrode of the first switching transistor on opposite sides of the gate line;

a second storage capacitor connected between the second pixel electrode and a storage common voltage line that receives a constant storage common voltage; and a second liquid crystal layer interposed between the second pixel electrode and the common electrode, wherein the AC common voltage is less than the constant storage common voltage during a data storage period and is greater than the constant storage common voltage during a light-emitting period.

2. The liquid crystal display apparatus as claimed in claim 1, wherein: the AC common voltage applied to the first storage capacitor through the common voltage line has a second voltage difference with respect to the constant storage common voltage during a light-emitting period, and the second voltage difference is determined so that the first pixel electrode and the second pixel electrode have the first voltage difference during the light-emitting period.

3. The liquid crystal display apparatus as claimed in claim 1, further comprising:

a gate driver for outputting a gate signal to each pixel of the plurality of pixels through the gate line;

a data driver for generating a data signal corresponding to an input image and outputting the data signal to each pixel of the plurality of pixels through the data line; and a common voltage driver for generating the AC common voltage and outputting the AC common voltage to each pixel of the plurality of pixels through the common voltage line, wherein the common voltage driver generates the AC common voltage so as to have a second voltage difference with respect to the constant storage common voltage during a light-emitting period, and wherein the second voltage difference is determined so that the first pixel electrode and the second pixel electrode have the first voltage difference during the light-emitting period.

4. The liquid crystal display apparatus as claimed in claim 1, wherein: a liquid crystal layer of each of the first sub-pixel and the second sub-pixel is a twisted nematic (TN) mode or a vertical alignment (VA) mode liquid crystal layer.

5. The liquid crystal display apparatus as claimed in claim 1, wherein: the first voltage difference is determined so that a differential function of a mean graph of a voltage-transmittance graph of a liquid crystal layer of the first sub-pixel and a voltage-transmittance graph of a liquid crystal layer of the second sub-pixel does not have a point corresponding to a value of zero.

6. The liquid crystal display apparatus as claimed in claim 1, wherein: a liquid crystal layer of each of the first sub-pixel and the second sub-pixel is a twisted nematic (TN) mode or a vertical alignment (VA) mode liquid crystal layer.

7. The liquid crystal display apparatus as claimed in claim 1, wherein: the first voltage difference is determined so that a differential function of a mean graph of a voltage-transmittance graph of a liquid crystal layer of the first sub-pixel and a voltage-transmittance graph of a liquid crystal layer of the second sub-pixel does not have a point corresponding to a value of zero.

8. The liquid crystal display apparatus as claimed in claim 1, wherein the first voltage difference is adjustable.

9. The liquid crystal display apparatus as claimed in claim 1, wherein the first voltage difference is adjustable by a user.

10. A method of driving a liquid crystal display apparatus0 comprising a plurality of pixels, wherein each pixel of the plurality of pixels comprises at least two sub-pixels, and at least two storage capacitors corresponding to at least two sub-pixels, the method comprising:

applying a constant storage common voltage to a first storage capacitor from among at least two storage capacitors; and applying an AC common voltage to a second storage capacitor from among at least two storage capacitors, wherein the constant storage common voltage and the AC common voltage have a second voltage difference, at least during a light-emitting period, when a backlight unit of the liquid crystal display apparatus emits light, and wherein the second voltage difference is determined so that pixel electrodes of at least two sub-pixels have a first voltage difference during the light-emitting period, wherein the AC common voltage is less than the constant storage common voltage during a data storage period and is greater than the constant storage common voltage during a light-emitting period.

11. The method of claim 10, wherein applying the AC common voltage includes:

applying the AC common voltage with a lower level than the constant storage common voltage, during a data storage period, when a data signal is applied to at least two sub-pixels; and applying the AC common voltage with a higher level than the constant storage common voltage, during the light-emitting period.

12. The method of claim 10, wherein: the liquid crystal display apparatus includes a twisted nematic (TN) mode or a vertical alignment (VA) mode liquid crystal layer.

13. The method of claim 10, wherein: the first voltage difference is determined so that a differential function of a mean graph of a voltage-transmittance graph of a liquid crystal layer of the first sub-pixel, from among at least two sub-pixels and a voltage-transmittance graph of a liquid crystal layer of the second sub-pixel, from among at least two sub-pixels, does not have a point corresponding to a value of zero.

* * * * *